US007495380B2

(12) United States Patent
Jun

(10) Patent No.: US 7,495,380 B2
(45) Date of Patent: Feb. 24, 2009

(54) LIGHT EMISSION DEVICE AND DISPLAY DEVICE USING THE LIGHT EMISSION DEVICE AS LIGHT SOURCE

(75) Inventor: Pil-Goo Jun, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 11/690,070

(22) Filed: Mar. 22, 2007

(65) Prior Publication Data

US 2007/0267963 A1 Nov. 22, 2007

(30) Foreign Application Priority Data

May 19, 2006 (KR) ..... 10-2006-0045222

(51) Int. Cl.
*H01J 1/62* (2006.01)

(52) U.S. Cl. ..... 313/495

(58) Field of Classification Search ..... 313/495–497
See application file for complete search history.

(56) References Cited

U.S. PATENT DOCUMENTS

| | | | | |
|---|---|---|---|---|
| 5,646,702 | A | 7/1997 | Akinwande et al. | |
| 6,838,828 | B2 * | 1/2005 | Joo et al. | 313/584 |
| 2003/0122771 | A1 | 7/2003 | Sumiyoshi et al. | |
| 2004/0125062 | A1 * | 7/2004 | Yamamoto et al. | 345/87 |
| 2004/0222734 | A1 | 11/2004 | Oh | |

FOREIGN PATENT DOCUMENTS

| | | | |
|---|---|---|---|
| EP | 1 172 836 | A1 | 1/2002 |
| EP | 1 519 217 | A1 | 3/2005 |
| EP | 1 544 891 | A1 | 6/2005 |
| JP | 10-153979 | | 6/1998 |
| KR | 2002-0057618 | | 7/2002 |
| KR | 10-2005-0079340 | | 8/2005 |
| KR | 10-2005-0113824 | | 12/2005 |
| KR | 10-2005-0113868 | | 12/2005 |
| WO | WO 02/069030 | A2 | 9/2002 |

OTHER PUBLICATIONS

Korean Patent Abstracts, Publication No. 1020020057618 A, dated Jul. 12, 2002, in the name of Gi Jin Kwon.

(Continued)

*Primary Examiner*—Joseph L Williams
(74) *Attorney, Agent, or Firm*—Christie, Parker & Hale, LLP

(57) ABSTRACT

A light emission device and a display device using the light emission device as a light source are provided. The light emission device includes first and second substrates facing each other and forming a vacuum vessel, an electron emission unit located on the first substrate, and a light emission unit located on the second substrate. The light emission unit includes a plurality of phosphor layers located on the second substrate and spaced from each other, a heat dissipation layer located between the phosphor layers and having an end extending to outside of the vacuum vessel to be exposed to air, and an anode electrode located at one side of the phosphor layers and the heat dissipation layer.

20 Claims, 5 Drawing Sheets

OTHER PUBLICATIONS

Korean Patent Abstracts, Publication No. 1020050113824 A, dated Dec. 5, 2005, in the name of Seong Yeon Hwang.

Patent Abstracts of Japan, Publication No. 10-153979; Date of Publication: Jun. 9, 1998; in the name of Mutsuzou Suzuki et al.

Korean Patent Abstracts, Publication No. 1020050079340 A; Date of Publication: Aug. 10, 2005; in the name of Hang Woo Lee et al.

Korean Patent Abstracts, Publication No. 1020050113868 A; Date of Publication: Dec. 5, 2005; in the name of Soo Joung Lee et al.

European Search Report dated Sep. 12, 2007 for corresponding European Patent Application No. 07108201.0.

Search Report dated Jun. 26, 2008 for corresponding European Patent Application No. 07108201.0, indicating the relevance of the cited references.

* cited by examiner

LIGHT EMISSION DEVICE AND DISPLAY DEVICE USING THE LIGHT EMISSION DEVICE AS LIGHT SOURCE

CROSS-REFERENCE TO RELATED APPLICATION

This application claims priority to and the benefit of Korean Patent Application No. 10-2006-0045222 filed on May 19, 2006, in the Korean Intellectual Property Office, the entire content of which is incorporated herein by reference.

BACKGROUND OF THE INVENTION

1. Field of the Invention

The present invention relates to a display device, and more particularly, to a light emission device for emitting light using electron emission regions and a phosphor layer, and a display device using the light emission device as a light source.

2. Description of Related Art

A light emission device that includes front and rear substrates facing each other with a gap therebetween, a plurality of electron emission regions provided on the rear substrate, and a phosphor layer and an anode electrode provided on the front substrate is well known. The light emission device has a simplified optical member and lower power consumption than both a cold cathode fluorescent lamp (CCFL) type light emission device and a light emitting diode (LED) type light emission device.

The rear and front substrates are sealed together at their peripheries using a sealing member to form a vacuum vessel. In the light emission device, electrons emitted from the electron emission regions are accelerated toward the phosphor layer by an anode voltage applied to the anode electrode, and excite the phosphor layer to emit visible light. The luminance of a light emission surface is proportional to the anode voltage.

The light emission device can be used as a light source in a display device including a non-self emissive type display panel. In the light emission device, a large amount of heat is generated from the front substrate by the continuous electron collision with the phosphor layer. However, since the front substrate is disposed facing the display panel, it is very difficult to install a cooling device. Therefore, the heat generated from the front substrate causes the deterioration of not only the performance of the display panel but also of the light emission efficiency of the phosphor layer that is exposed to the heat for a long time.

In addition, the light emission device is driven so as to maintain a predetermined brightness all the entire light emission surface when the display device is driven. Therefore, it is difficult to improve the display quality to a sufficient level.

Therefore, it is desirable to provide a light emission device that can overcome the shortcomings of the conventional light emission devices to better dissipate heat and/or to improve the dynamic contrast of the image displayed by the display device.

SUMMARY OF THE INVENTION

Exemplary embodiments in accordance with the present invention provide a light emission device that can dissipate the heat generated from a front substrate and a display device, which uses the light emission device as a light source to reduce or prevent the performance deterioration of a display panel.

Exemplary embodiments in accordance with the present invention also provide a light emission device that can independently control light intensities of a plurality of divided regions of a light emission surface and a display device that can enhance the dynamic contrast of the screen by using the light emission device as a light source.

According to an exemplary embodiment of the present invention, a light emission device includes: first and second substrates facing each other and forming a vacuum vessel; an electron emission unit located on the first substrate; and a light emission unit located on the second substrate. The light emission unit includes a plurality of phosphor layers located on the second substrate and spaced from each other, a heat dissipation layer located between the phosphor layers and having an end extending to outside of the vacuum vessel to be exposed to air, and an anode electrode located at one side of the phosphor layers and the heat dissipation layer.

The heat dissipation layer may be formed of a carbon-based conductive material. Alternatively, the heat dissipation layer may include a metal selected from the group consisting of Al, Ag, Cu, Au, Pt, and an alloy thereof.

The anode electrode may include a metal layer located on the phosphor layers and the heat dissipation layer at a side facing the first substrate. Alternatively, the anode electrode may include a transparent conductive layer located on the phosphor layers and the heat dissipation layer at a side facing the second substrate.

The electron emission unit may include first and second electrodes insulated from each other and crossing each other and electron emission regions electrically connected to one of the first electrodes or the second electrodes.

According to another exemplary embodiment of the present invention, a display device includes: a display panel for displaying an image; a light emission device for emitting light toward the display panel. The light emission device includes: first and second substrates facing each other and forming a vacuum vessel; an electron emission unit located on the first substrate; and a light emission unit including a plurality of phosphor layers located on the second substrate and spaced from each other, a heat dissipation layer located between the phosphor layers and having an end extending to outside of the vacuum vessel to be exposed to air, and an anode electrode located at one side of the phosphor layers and the heat dissipation layer.

The display panel includes first pixels and the light emission device includes second pixels. The number of the second pixels may be less than that of the first pixels and light emission intensities of the second pixels may be independently controlled. The display panel may be a liquid crystal display panel.

The electron emission unit may include first electrodes and second electrodes crossing the first electrodes, wherein the first electrodes are insulated from the second electrodes; and electron emission regions electrically connected to the first electrodes or the second electrodes. The electron emission regions may include a material that emits electrons in response to an electric field. The electron emission regions may include at least one of a carbon-based material or a nanometer-sized material.

BRIEF DESCRIPTION OF THE DRAWINGS

A more complete appreciation of the present invention and many of the attendant features and advantages thereof, will be readily apparent as the present invention becomes better understood by reference to the following detailed description when considered in conjunction with the accompanying drawings in which like reference symbols indicate like components, wherein.

DETAILED DESCRIPTION

The present invention will now be described more fully with reference to the accompanying drawings, in which exemplary embodiments of the invention are shown. The invention may, however, be embodied in many different forms and should not be construed as being limited to the embodiments set forth herein; rather these embodiments are provided so that this disclosure will be thorough and complete, and will fully convey the concept of the invention to those skilled in the art.

Figure 1:
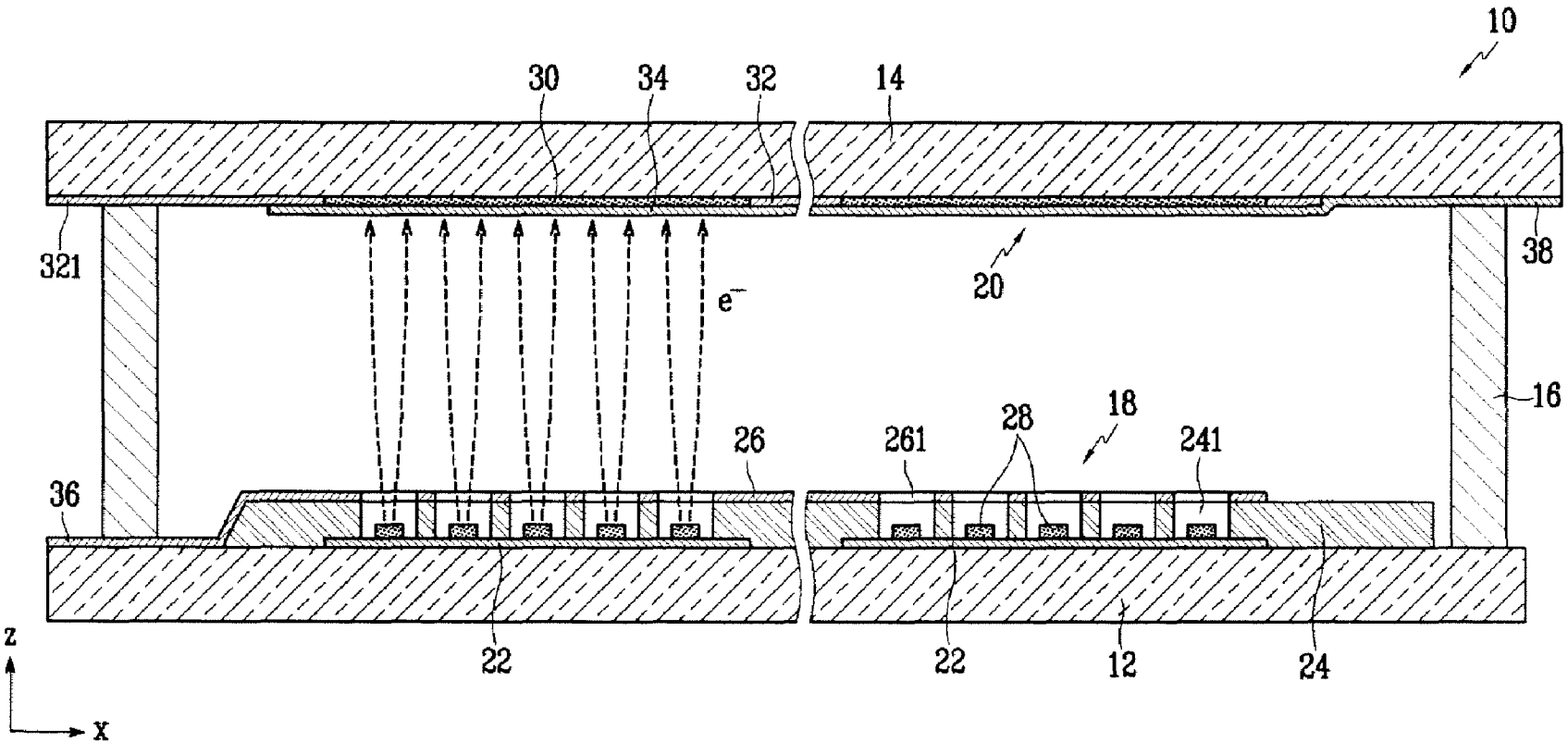
FIG. 1 is a sectional view of a light emission device according to an embodiment of the present invention.

FIG. 1 is a sectional view of a light emission device according to an embodiment of the present invention.

Referring to FIG. 1, a light emission device 10 of the present embodiment includes first and second substrates 12 and 14 facing each other with a predetermined distance between them. A sealing member 16 is provided at the peripheries of the first and second substrates 12 and 14 to seal them together and thus form a sealed vessel. The interior of the sealed vessel is kept to a degree of vacuum of about $10^{-6}$ Torr. Hence, the substrates 12, 14 and the sealing member 16 can be said to form a vacuum envelope (or a vacuum vessel).

Each of the first and second substrates 12 and 14 has an active area emitting visible light and an inactive area surrounding the active area within an area surrounded by the sealing member 16. An electron emission unit 18 for emitting electrons is provided on the active area of the first substrate 12, and a light emission unit 20 for emitting the visible light is provided on the active area of the second substrate 14.

Figure 2:
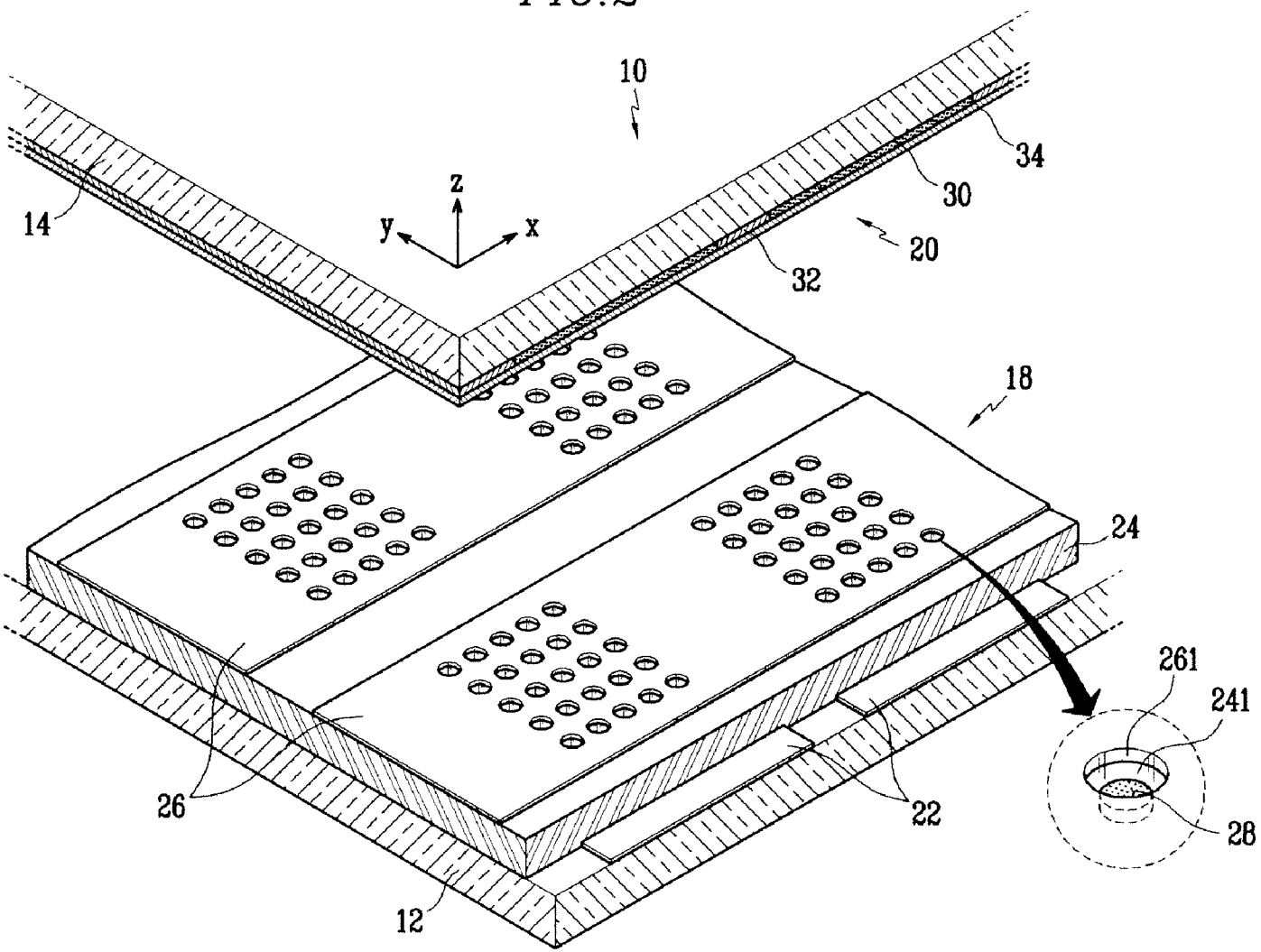
FIG. 2 is a partial exploded perspective view of an active area of the light emission device of FIG. 1.

FIG. 2 is a partial exploded perspective view of an active area of the light emission device of FIG. 1.

Referring to FIGS. 1 and 2, the electron emission unit 18 includes first electrodes 22 and second electrodes 26 insulated from each other by an insulating layer 24 and electron emission regions 28 electrically connected to the first electrodes 22. In other embodiments, the electron emission regions 28 may be electrically connected to the second electrodes 26.

When the electron emission regions 28 are formed on the first electrodes 22, the first electrodes 22 are cathode electrodes for applying a current to the electron emission regions 28 and the second electrodes 26 are gate electrodes for inducing the electron emission by forming the electric field around the electrode emission regions 28 according to a voltage difference between the cathode and gate electrodes. On the contrary, when the electron emission regions 28 are formed on the second electrodes 26, the second electrodes 26 are the cathode electrodes and the first electrodes 22 are the gate electrodes.

Among the first and second electrodes 22 and 26, the electrodes arranged along rows of the light emission device 10 function as scan electrodes and the electrodes arranged along columns function as data electrodes.

In FIGS. 1 and 2, an example where the electron emission regions 28 are formed on the first electrodes 22, the first electrodes 22 are arranged along the columns (i.e., in a direction of a y-axis in FIGS. 1 and 2) of the light emission device 10, and the second electrodes 26 are arranged along the rows (i.e., in a direction of an x-axis in FIGS. 1 and 2) of the light emission device 10 is illustrated. However, the arrangements of the electron emission regions 28 and the first and second electrodes 22 and 26 are not limited to the above case.

Openings 241 and 261 are respectively formed through the insulating layer 24 and the second electrodes 26 at crossed regions of the first and second electrodes 22 and 26 to partly expose the surface of the first electrodes 22. The electron emission regions 28 are formed on the first electrodes 22 through the openings 241 of the insulating layer 24.

The electron emission regions 28 are formed of a material that emits electrons when an electric field is applied thereto under a vacuum condition, such as a carbon-based material or a nanometer-sized material. The electron emission regions 28 can be formed of carbon nanotubes, graphite, graphite nanofibers, diamonds, diamond-like carbon, $C_{60}$, silicon nanowires or a combination thereof. The electron emission regions 28 can be formed, for example, through a screen-printing process, a direct growth, a chemical vapor deposition, or a sputtering process.

Alternatively, the electron emission regions can be formed in a tip structure formed of a Mo-based or Si-based material.

One crossed region of the first and second electrodes 22 and 26 may correspond to one pixel region of the light emission device 10. Alternatively, two or more crossed regions of the first and second electrodes 22 and 26 may correspond to one pixel region of the light emission device 10. In this case according to one embodiment, two or more first electrodes 22 and/or two or more second electrodes 26 that are placed in one pixel region are electrically connected to each other to receive a common drive voltage.

The light emission unit 20 includes a plurality of phosphor layers 30 formed (e.g., in a tetragonal shape) on the second substrate 14 and spaced from each other in a predetermined pattern, a heat dissipation layer 32 formed between the phosphor layers 30 in a predetermined pattern (e.g., lattice pattern), and an anode electrode 34 formed at a side (or a surface) of the phosphor layers 30 and the heat dissipation layer 32 facing the first substrate 12.

Figure 3:
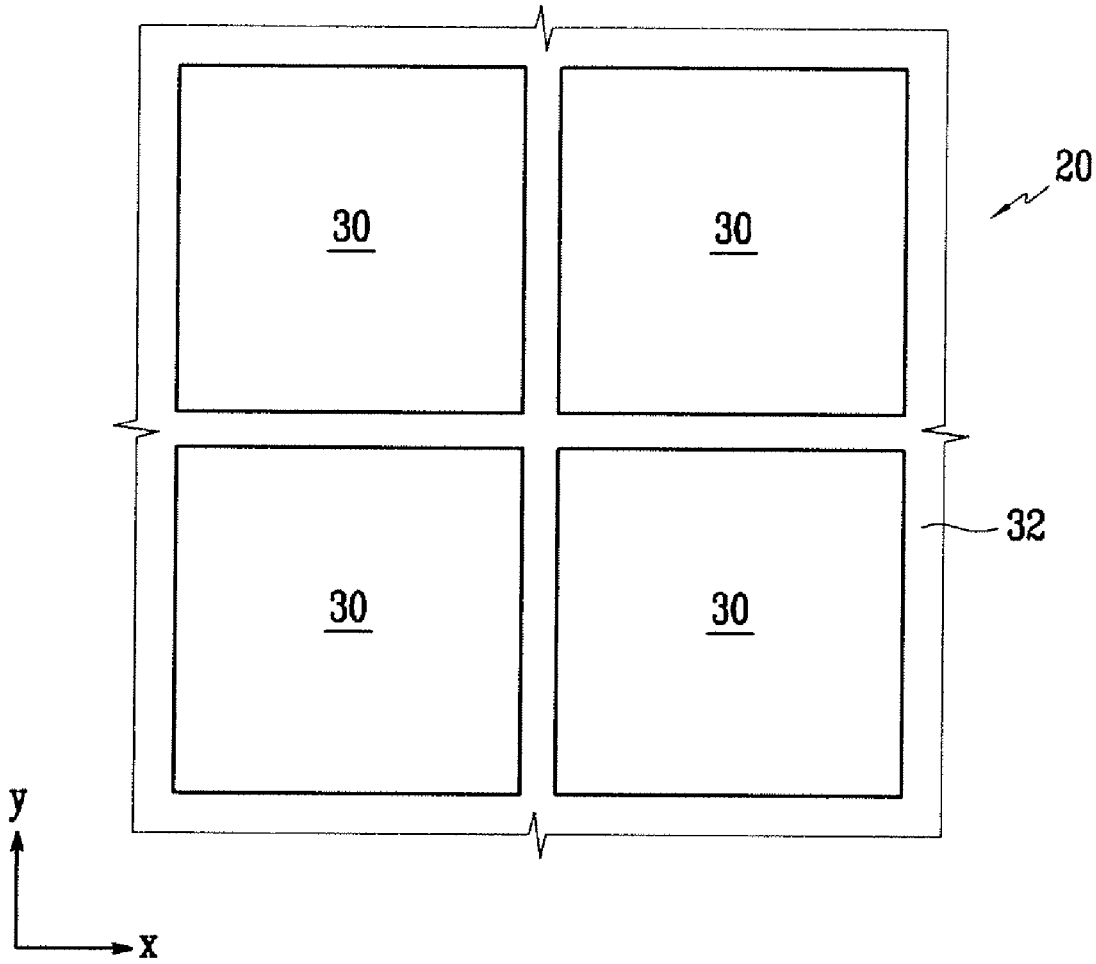
FIG. 3 is a partial top view of a light emission unit of the light emission device of FIG. 1.

The phosphor layers 30 may be white phosphor layers. One or more phosphor layers may correspond to one pixel region. Alternatively, one phosphor layer may correspond to two or more pixel regions. In all of these cases, each phosphor layer 30 may be formed in a rectangular shape as shown in FIG. 3.

The heat dissipation layer 32 is formed of a material having a high thermal conductivity. For example, the heat dissipation layer 32 may be formed of carbon-based conductive material such as graphite. Alternatively, the heat dissipation layer 32 may includes metal selected from the group consisting of Al, Ag, Cu, Au, Pt, and an alloy thereof.

Figure 4:
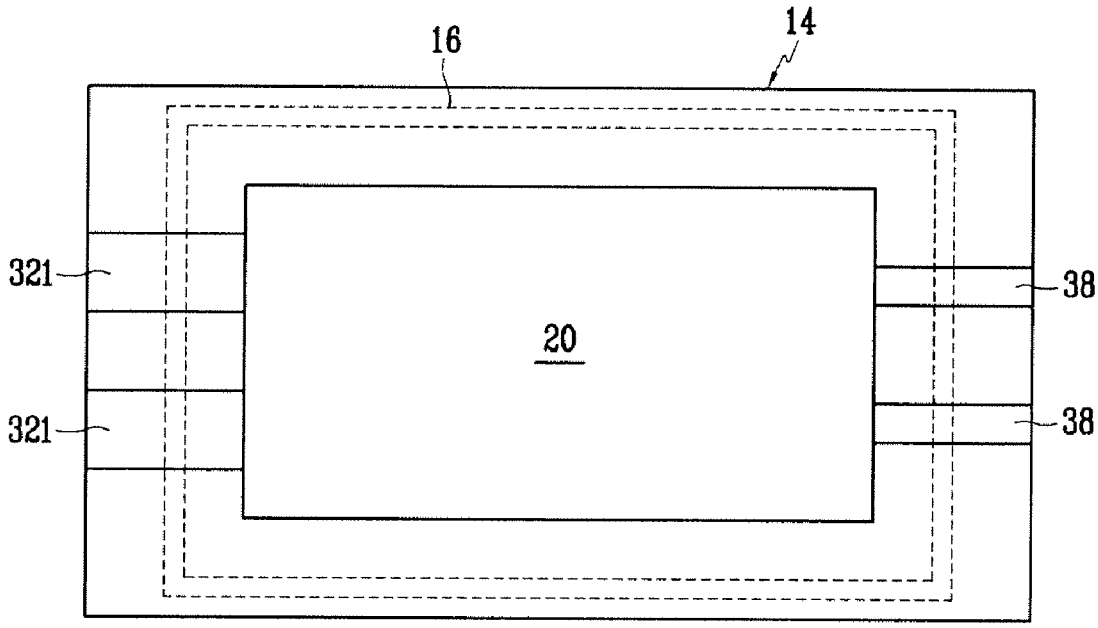
FIG. 4 is a top view of a second substrate of the light emission device of FIG. 1.

The heat dissipation layer 32 may be formed in a lattice pattern in response to the pattern of the phosphor layers 30. As shown in FIG. 4, an end 321 of the heat dissipation layer 32 extends to an external side through the sealing member 16 (i.e., extends to outside of the vacuum envelope) to quickly dissipate heat, which is generated from the second substrate 14 during the operation of the light emission device, to air.

The anode electrode 34 may be formed of metal such as Al and cover the phosphor layers 30 and the heat dissipation layer 32. The anode electrode 34 is an acceleration electrode that receives a high voltage to maintain the phosphor layer 30 at a high electric potential state. The anode electrode 34 enhances the luminance by reflecting the visible light, which is emitted from the phosphor layers 30 toward the first substrate 12, to the second substrate 14.

Disposed between the first and second substrates 12 and 14 are spacers (not shown) for uniformly maintaining a gap between the first and second substrates 12 and 14 against an external force or pressure.

The above-described light emission device 10 is driven by applying driving voltages to the first and second electrodes 22 and 26 and applying thousands of volt of a positive DC voltage to the anode electrode 34. In FIG. 1, the reference numbers 36 and 38 indicate second electrode leads extending from the second electrodes 26 and anode leads extending from the anode electrode 34, respectively.

Then, an electric field is formed around the electron emission regions 28 at pixels where a voltage difference between the first and second electrodes 22 and 26 is higher than a threshold value, thereby emitting electrons from the electron emission regions 28. The emitted electrons are accelerated by the high voltage applied to the anode electrode 34 to collide with the corresponding phosphor layer 30, thereby exciting the phosphor layer 30. A light emission intensity of the phosphor layer 30 at each pixel corresponds to an electron emission amount of the corresponding pixel.

In the above-described driving process, heat is generated from the second substrate 14, on which the phosphor layers 30 and the anode electrode 34 are placed, by the collision of the electrons with the phosphor layers 30. In the light emission device 10 according to this embodiment, to dissipate the heat, the heat dissipation layer 32 formed of a high thermal conductivity material is formed between the phosphor layers 30 such that an end 321 of the heat dissipation layer 32 is exposed to the air. Therefore, the heat generated from the second substrate 14 is quickly dissipated to the air through the heat dissipation layer 32, thereby lowering the temperature of the second substrate 14 and thus enhancing the light emission efficiency.

Therefore, power consumption can be reduced or minimized because no additional cooling device for reducing the temperature of the light emission device 10 is required. In addition, the light emission device 10 of this embodiment may be used as a light source of a display device by being disposed in rear of (i.e., located behind) the display panel. In this case, the performance deterioration of the display panel due to the heat generated from the second substrate can be reduced or prevented.

Figure 5:
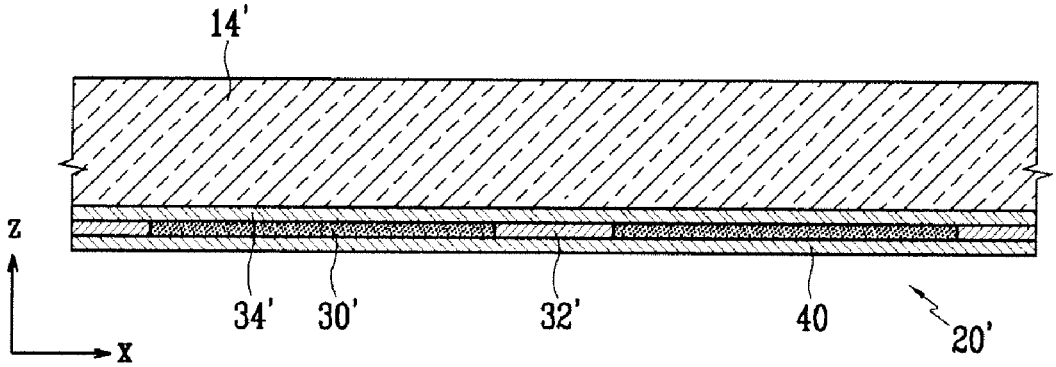
FIG. 5 is a partial enlarged sectional view of a second substrate and a light emission unit of a light emission device according to another embodiment of the present invention.

FIG. 5 is a partial enlarged sectional view of a second substrate and a light emission unit of a light emission device according to another embodiment of the present invention.

Referring to FIG. 5, a light emission unit 20' of this embodiment includes an anode electrode 34' formed on a second substrate 14' using a transparent conductive material such as ITO, a plurality of phosphor layers 30' formed on the anode electrode 34' and spaced from each other in a predetermined pattern, and a heat dissipation layer 32' formed between the phosphor layers 30'.

A metal reflective layer 40 may be formed on the phosphor layers 30' and the heat dissipation layer 32'. The materials and shapes of the phosphor layers 30' and the heat dissipation layer 32' are identical to those of the phosphor layers 30 and the heat dissipation layer 32 of the above described embodiment. The metal reflective layer 40 may be formed of Al.

In the above embodiments, the gap between the first and second substrates 12 and 14 may be in the range of, for example, 5-20 mm. The anode electrode 34 receives a high voltage of at least 10 kV through the anode lead 38. In one embodiment, the high voltage is in the range of about 10 kV to 15 kV. Accordingly, the inventive light emission device 10 realizes a luminance of more than 10,000 cd/m$^2$ at a central portion of the active area.

Figure 6:
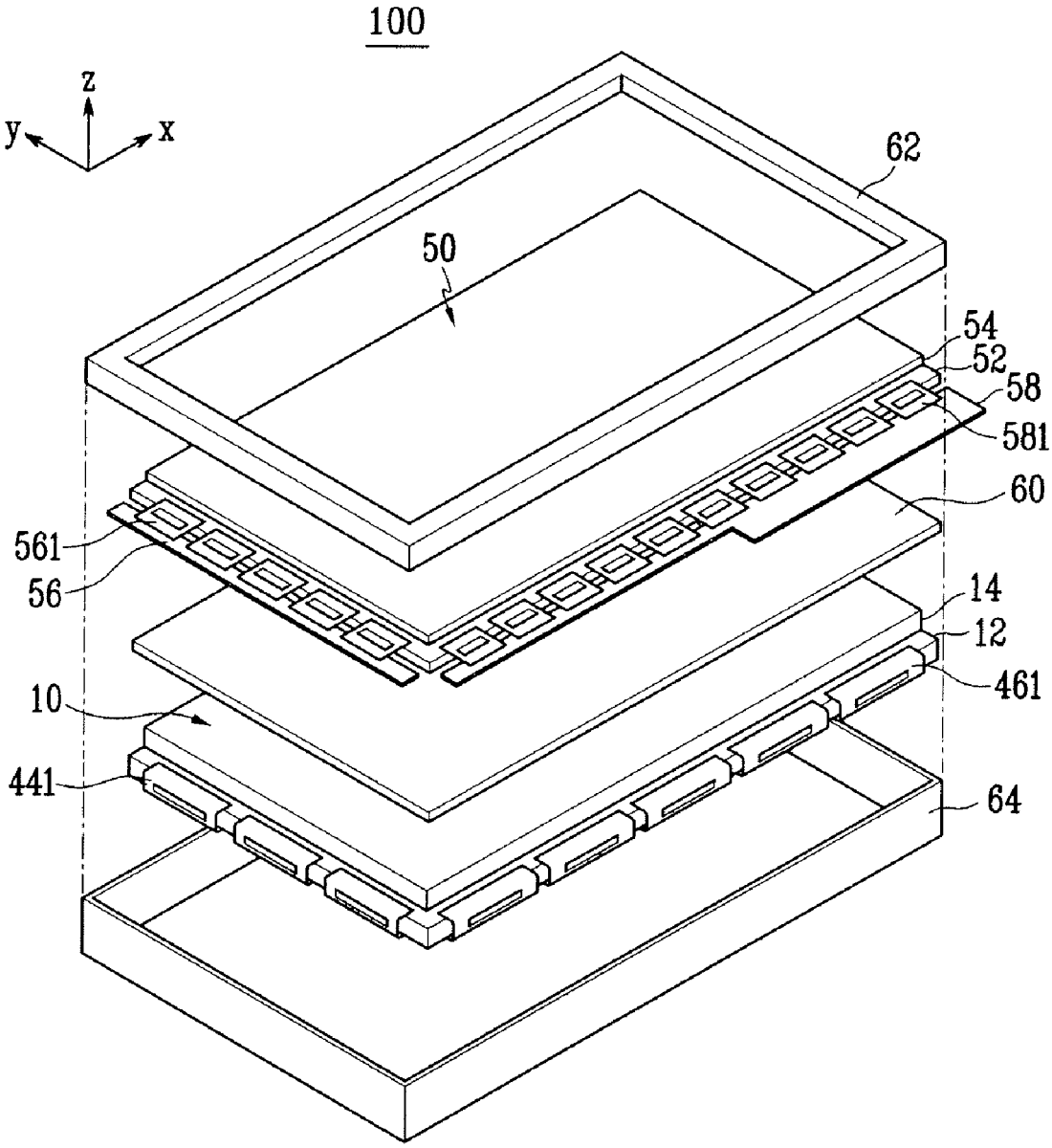
FIG. 6 is an exploded perspective view of a liquid crystal display according to an embodiment of the present invention.

FIG. 6 is an exploded perspective view of a display device according to an embodiment of the present invention. The display device of FIG. 6 is exemplary only, does not limit the present invention.

Referring to FIG. 6, a display device 100 of this embodiment includes a light emission device 10 and a display panel 50 disposed in front of the light emission device 10. A diffuser 60 for uniformly diffusing the light emitted from the light emission device 10 toward the display panel 50 may be disposed between the display panel 50 and the light emission device 10. The diffuser 60 may be spaced apart from the light emission device 10 by a predetermined distance. A top chassis 62 is disposed in front of the display panel 50 and a bottom chassis 64 is disposed at the rear of the light emission device 10.

The display panel 50 may be a liquid crystal display panel or any other non-self emissive display panel. In the following description, a liquid crystal display panel is exampled.

The display panel 50 includes a thin film transistor (TFT) substrate 52 comprised of a plurality of TFTs, a color filter substrate 54 disposed on the TFT substrate 52, and a liquid crystal layer (not shown) disposed between the TFT substrate 52 and the color filter substrate 54. Polarizer plates (not shown) are attached on a top surface of the color filter substrate 54 and a bottom surface of the TFT substrate 52 to polarize the light passing through the display panel 50.

The TFT substrate 52 is a glass substrate on which the TFTs are arranged in a matrix pattern. A data line is connected to a source terminal of one TFT and a gate line is connected to a gate terminal of the TFT. In addition, a pixel electrode formed of a transparent conductive layer is connected to a drain terminal of the TFT.

When electrical signals are input from circuit board assemblies 56 and 58 to the respective gate and data lines, electrical signals are input to the gate and source terminals of the TFT. Then, the TFT turns on or off according to the electrical signals input thereto, and outputs an electrical signal required for driving the pixel electrode to the drain terminal.

RGB color filters are formed on the color filter substrate 54 so as to emit predetermined colors as the light passes through the color filter substrate 54. A common electrode formed of a transparent conductive layer is deposited on an entire surface of the color filter substrate 54.

When electrical power is applied to the gate and source terminals of the TFTs to turn on the TFTs, an electric field is formed between the pixel electrode and the common electrode. Due to the electric field, the orientation of liquid crystal molecules of the liquid crystal layer can be varied, and thus the light transmissivity of each pixel can be varied according to the orientation of the liquid crystal molecules.

The circuit board assemblies 56 and 58 of the display panel 50 are connected to drive IC packages 561 and 581, respectively. In order to drive the display panel 50, the gate circuit board assembly 56 transmits a gate drive signal and the data circuit board assembly 58 transmits a data drive signal.

The number of pixels of the light emission device 10 is less than that of the display panel 50 so that one pixel of the light emission device 10 corresponds to two or more pixels of the display panel 50. Each pixel of the light emission device 10 emits light in response to the highest gray value among the corresponding pixels of the display panel 50. The light emission device 10 can represent 2~8 bits gray value at each pixel.

For convenience, the pixels of the display panel 50 will be referred to as first pixels and the pixels of the light emission device 10 will be referred to as second pixels. In addition, a plurality of first pixels corresponding to one second pixel will be referred to as a first pixel group.

In order to drive the light emission device 10, a signal control unit (not shown) for controlling the display panel 50 detects a highest gray value among the first pixels of the first pixel group, calculates a gray value required for the light emission of the second pixel according to the detected gray value, converts the calculated gray value into digital data, and generates a driving signal of the light emission device 10 using the digital data. The drive signal of the light emission device 10 includes a scan drive signal and a data drive signal.

Circuit board assemblies (not shown), that is a scan circuit board assembly and a data circuit board assembly, of the light emission device 10 are connected to drive IC packages 441 and 461, respectively. In order to drive the light emission device 10, the scan circuit board assembly transmits a scan drive signal and the data circuit board assembly transmits a data drive signal. One of the first and second electrodes receives the scan drive signal and the other receives the data drive signal.

Therefore, when an image is to be displayed by the first pixel group, the corresponding second pixel of the light emission device 10 is synchronized with the first pixel group to emit light with a predetermined gray value. The light emission device 10 has pixels arranged in rows and columns. The number of pixels arranged in each row may be 2 through 99 and the number of pixels arranged in each column may be 2 through 99.

As described above, in the light emission device 10, the light emission intensities of the pixels of the light emission device 10 are independently controlled to emit a proper intensity of light to each first pixel group of the display panel 50. As a result, the display device 100 in accordance with one embodiment of the present invention can enhance the dynamic contrast and image quality of the screen.

Although exemplary embodiments of the present invention have been described in detail hereinabove, it should be clearly understood that many variations and/or modifications of the basic inventive concept taught herein still fall within the spirit and scope of the present invention, as defined by the appended claims and their equivalents.

What is claimed is:

1. A light emission device comprising:

a first substrate;

a second substrate facing the first substrate, wherein the first and second substrates form a vacuum vessel;

an electron emission unit located on the first substrate; and a light emission unit located on the second substrate, the light emission unit comprising:

a plurality of phosphor layers located on the second substrate and spaced from each other;

a heat dissipation layer located between the phosphor layers and having an end extending to outside of the vacuum vessel to be exposed to air; and an anode electrode located at one side of the phosphor layers and the heat dissipation layer.

2. The light emission device of claim 1, wherein the heat dissipation layer is formed of a carbon-based conductive material.

3. The light emission device of claim 1, wherein the heat dissipation layer includes a metal selected from the group consisting of Al, Ag, Cu, Au, Pt, and an alloy thereof.

4. The light emission device of claim 1, wherein each of the phosphor layers is formed in a tetragonal shape and the heat dissipation layer is formed in a lattice pattern.

5. The light emission device of claim 1, wherein the anode electrode comprises a metal layer located on the phosphor layers and the heat dissipation layer, and wherein the one side faces the first substrate.

6. The light emission device of claim 1, wherein the anode electrode comprises a transparent conductive layer located on the phosphor layers and the heat dissipation layer, and wherein the one side faces the second substrate.

7. The light emission device of claim 6, wherein the light emission unit further comprises a metal layer located on the phosphor layers and the heat dissipation layer at a side facing the first substrate.

8. The light emission device of claim 1, wherein the electron emission unit comprises first electrodes and second electrodes crossing each other, wherein the first electrodes are insulated from the second electrodes; and electron emission regions electrically connected to one of the first electrodes or the second electrodes.

9. The light emission device of claim 8, wherein the electron emission regions include at least one of a carbon-based material or a nanometer-sized material.

10. A display device comprising:

a display panel for displaying an image;

a light emission device for emitting light toward the display panel, wherein the light emission device comprises:

a first substrate;

a second substrate facing the first substrate, wherein the first and second substrates form a vacuum vessel;

an electron emission unit located on the first substrate; and a light emission unit including a plurality of phosphor layers located on the second substrate and spaced from each other, a heat dissipation layer located between the phosphor layers and having an end extending to outside of the vacuum vessel to be exposed to air, and an anode electrode located at one side of the phosphor layers and the heat dissipation layer.

11. The display device of claim 10, wherein the heat dissipation layer is formed of a carbon-based conductive material.

12. The display device of claim 10, wherein the heat dissipation layer includes a metal selected from the group consisting of Al, Ag, Cu, Au, Pt, and an alloy thereof.

13. The display device of claim 10, wherein each of the phosphor layers is formed in a tetragonal shape and the heat dissipation layer is formed in a lattice pattern.

14. The display device of claim 10, wherein the anode electrode comprises a metal layer located on the phosphor layers and the heat dissipation layer, and wherein the one side faces the first substrate.

15. The display device of claim 10, wherein the anode electrode comprises a transparent conductive layer located on the phosphor layers and the heat dissipation layer, and wherein the one side faces the second substrate.

16. The display device of claim 15, wherein the light emission unit further includes a metal layer located on the phosphor layers and the heat dissipation layer at a side facing the first substrate.

17. The display device of claim 10, wherein the electron emission unit comprises first electrodes and second electrodes crossing each other, wherein the first electrodes are insulated from the second electrodes; and electron emission regions electrically connected to the first electrodes or the second electrodes.

18. The display device of claim 17, wherein the electron emission regions include at least one of a carbon-based material or a nanometer-sized material.

19. The display device of claim 10, wherein the display panel includes first pixels and the light emission device includes second pixels, wherein the number of the second pixels is less than that of the first pixels and light emission intensities of the second pixels are independently controlled.

20. The display device of claim 10, wherein the display panel is a liquid crystal display panel.

* * * * *